US006629322B1

(12) United States Patent
Monroe

(10) Patent No.: US 6,629,322 B1
(45) Date of Patent: Oct. 7, 2003

(54) MANUAL ASSISTED VERTICAL LIFT BED

(75) Inventor: Myron D. Monroe, Goshen, IN (US)

(73) Assignee: Skyline Corporation, Elkhart, IN (US)

( * ) Notice: Subject to any disclaimer, the term of this patent is extended or adjusted under 35 U.S.C. 154(b) by 0 days.

(21) Appl. No.: 10/157,961

(22) Filed: May 3, 2002

(51) Int. Cl.[7] ..... A47C 17/84
(52) U.S. Cl. ..... 5/10.2; 5/118; 5/11
(58) Field of Search ..... 5/118, 9.1, 11, 5/10.2, 10.1; 296/190.02

(56) References Cited

U.S. PATENT DOCUMENTS

| | | | | | |
|---|---|---|---|---|---|
| 2,531,140 | A | | 11/1950 | Linde | 296/100 |
| 3,028,606 | A | * | 4/1962 | Boutet | 5/9.1 |
| 3,141,178 | A | | 7/1964 | Campbell | 5/118 |
| 3,266,062 | A | | 8/1966 | Rogers | 5/118 |
| 3,282,566 | A | | 11/1966 | Clark | 254/122 |
| 3,480,975 | A | | 12/1969 | Racine et al. | 5/118 |
| 3,494,656 | A | | 2/1970 | McIntire | 296/23 |
| 3,579,671 | A | | 5/1971 | Kötter | 5/62 |
| 3,623,168 | A | | 11/1971 | Rouch | 5/10 |
| 3,665,527 | A | * | 5/1972 | Gonzalez | 5/10.2 |
| 3,745,595 | A | | 7/1973 | Nagy | 5/9 R |
| 3,772,716 | A | | 11/1973 | Ratcliff | 5/10 |
| 3,829,907 | A | | 8/1974 | Brunner | 5/8 |
| 3,829,912 | A | | 8/1974 | Quakenbrush | 5/10 B |
| 3,858,254 | A | | 1/1975 | Coomes | 5/8 |
| 3,874,009 | A | | 4/1975 | Nosaka et al. | 5/9 R |
| 3,909,857 | A | | 10/1975 | Herrera | 5/164 R |
| 3,911,832 | A | | 10/1975 | Vandergriff | 105/372 |
| 4,018,166 | A | | 4/1977 | Gutridge et al. | 105/316 |
| 4,055,366 | A | | 10/1977 | Lee | 296/23 G |
| 4,215,899 | A | | 8/1980 | Schmidt et al. | 296/190 |
| 4,243,260 | A | | 1/1981 | Gieseking | 296/24 R |
| 4,279,203 | A | | 7/1981 | Marulic | 105/321 |
| 4,362,258 | A | | 12/1982 | French | 224/309 |
| 4,558,648 | A | | 12/1985 | Franklin et al. | 108/147 |
| 4,565,291 | A | | 1/1986 | Khirwadkar | 212/180 |
| 4,826,235 | A | | 5/1989 | Zwick | 296/170 |
| 4,837,877 | A | * | 6/1989 | Hamada et al. | 5/10.2 |
| 4,973,101 | A | | 11/1990 | Sagstetter et al. | 296/160 |
| 4,981,319 | A | | 1/1991 | Gerzeny et al. | 296/26 |
| 5,020,169 | A | * | 6/1991 | Hamada et al. | 5/10.2 |
| 5,056,170 | A | * | 10/1991 | Kronshagen | 5/10.1 |
| 5,078,441 | A | | 1/1992 | Borskey | 296/26 |
| 5,092,650 | A | | 3/1992 | Perlot | 296/190 |
| 5,363,520 | A | | 11/1994 | Lyne, Jr. | 5/11 |
| 5,366,266 | A | | 11/1994 | Harbison | 296/100 |
| 5,377,787 | A | | 1/1995 | Chabrier | 187/404 |
| 5,461,735 | A | | 10/1995 | Danton | 5/10.2 |
| 5,502,850 | A | | 4/1996 | Lyne, Jr. | 5/11 |
| 5,598,591 | A | | 2/1997 | Kelley | 5/118 |
| 5,638,559 | A | | 6/1997 | Natri et al. | 5/10.2 |
| 5,732,425 | A | | 3/1998 | Leung | 5/611 |
| 5,778,799 | A | | 7/1998 | Eyre | 108/7 |
| 5,823,120 | A | | 10/1998 | Holmquist | 108/147 |
| 5,943,714 | A | | 8/1999 | Dignam | 5/10.1 |
| 5,984,404 | A | | 11/1999 | Novoa et al. | 296/190.02 |
| 6,231,114 | B1 | | 5/2001 | Warmoth | 296/170 |
| 6,325,447 | B1 | | 12/2001 | Kuo | 296/165 |

FOREIGN PATENT DOCUMENTS

| | | |
|---|---|---|
| GB | 2147500 | 5/1985 |

* cited by examiner

*Primary Examiner*—Michael Trettel
(74) *Attorney, Agent, or Firm*—Preston Gates Ellis & Rouvelas Meeds LLP

(57) ABSTRACT

The present invention relates to a manual assisted vertical lift bed used for increased sleeping capacity, storage and space in a confined living space. The lift bed may also provide safe operation for lowering and raising the lift bed through use of a bed frame, safety devices, and movement means.

22 Claims, 8 Drawing Sheets

MANUAL ASSISTED VERTICAL LIFT BED

FIELD OF THE INVENTION

The present invention relates to a manual assisted vertical lift bed used for increased sleeping capacity, storage and space in a confined living space. The lift bed may also provide safe operation for lowering and raising the lift bed through use of a bed frame, safety devices, and movement means.

BACKGROUND OF THE INVENTION

This invention relates to a bed frame and related apparatus suitable for installation in a confined living space, such as, for example, a recreational vehicle. In confined living spaces, there is a need to maximize space for storage, living and sleeping. Generally, beds and like sleeping arrangements occupy a large quantity of available space. Various beds and apparatus for confined living spaces are known, but do not provide both efficient use of space and safe, easy transitions from storage to use positions. Particularly, if a loft bed is also used to store items in its storage position, substantially horizontal positioning is needed in both the storage and use position and positions in between to prevent shifting or falling cargo. The present invention seeks to solve the inadequacies of the prior art.

SUMMARY OF THE INVENTION

The present invention discloses, for example, an apparatus for raising and lowering a bed frame or similar platform in a confined living space. Such confined living spaces include recreational vehicles, manufactured homes, trucks, vans, apartments and homes of similar dimensions. In one embodiment, the bed lift has a bed frame connected to a control arm assembly, vertical tracks attached to at least one wall of the confined living space, glide blocks adapted to fit and glide within the vertical tracks, a control arm assembly including at least two arms each with two ends, connected to a strut, and one end of each arm connected to a structure of the confined living space, such as a wall, for example, the other end of the arm connected to the bed frame, where the arms allow a controlled substantially vertical lift or lowering of the lift bed. In one embodiment, the lift bed may be raised or lowered by one person.

In one embodiment of the present invention, a vertical lift bed may include a bed frame connected to a control arm assembly for use in a confined living space. The control arm assembly may include at least two arms each with two ends connected to a strut, one end of each arm connected to a structure of the confined living space, such as a wall, for example, the other end of the arm connected to the bed frame, where the arms allow a controlled substantially vertical lift or lowering of the lift bed. A strut may be fastened to each end of each arm or may be attached at other appropriate locations.

In one embodiment, there may be vertical tracks attached to at least one wall of the confined living space, where the vertical tracks may include limiting devices to stop the motion of the lift bed. The limiting devices may be brackets or stops and may support the lift bed in an upward position. In yet another embodiment, the control arm assembly may maintain the lift bed in a substantially horizontal position. In another embodiment of the present invention, the lift bed also includes a safety restraint that may maintain the lift bed in an upward position. In one embodiment, the lift bed is adapted to be lowered or lifted in a single motion. In another embodiment of the present invention, the struts are self-contained gas struts. In still another embodiment the struts may be gas struts, spring struts, or other types of struts such as pneumatic struts.

One embodiment of the present invention includes a bed frame connected to a movement means for use in a confined living space, track means attached to the walls of the confined living space, glide means adapted to fit and glide within the track means, and a movement means. In another embodiment, the movement means comprises at least two arms each with two ends connected to a strut, one end of each arm connected to a structure of the confined living space, such as a wall, for example, the other end of the arm connected to the bed frame, where the arms allow a controlled substantially vertical lift or lowering of the lift bed and a strut fastened to the each end of the each arm. In another embodiment, the track means may include limiting devices to stop the motion-of the lift bed. In another embodiment, the limiting devices may support the lift bed in an upward position. In yet another embodiment, the movement means may maintain the lift bed in a substantially horizontal position.

Other objectives, features and advantages of the present invention will become apparent from the following detailed description. The detailed description and the specific examples, although indicating specific embodiments of the invention, are provided by way of illustration only. Accordingly, the present invention also includes those various changes and modifications within the spirit and scope of the invention that may become apparent to those skilled in the art from this detailed description.

DETAILED DESCRIPTION OF THE INVENTION

Figures 1A, 1B:
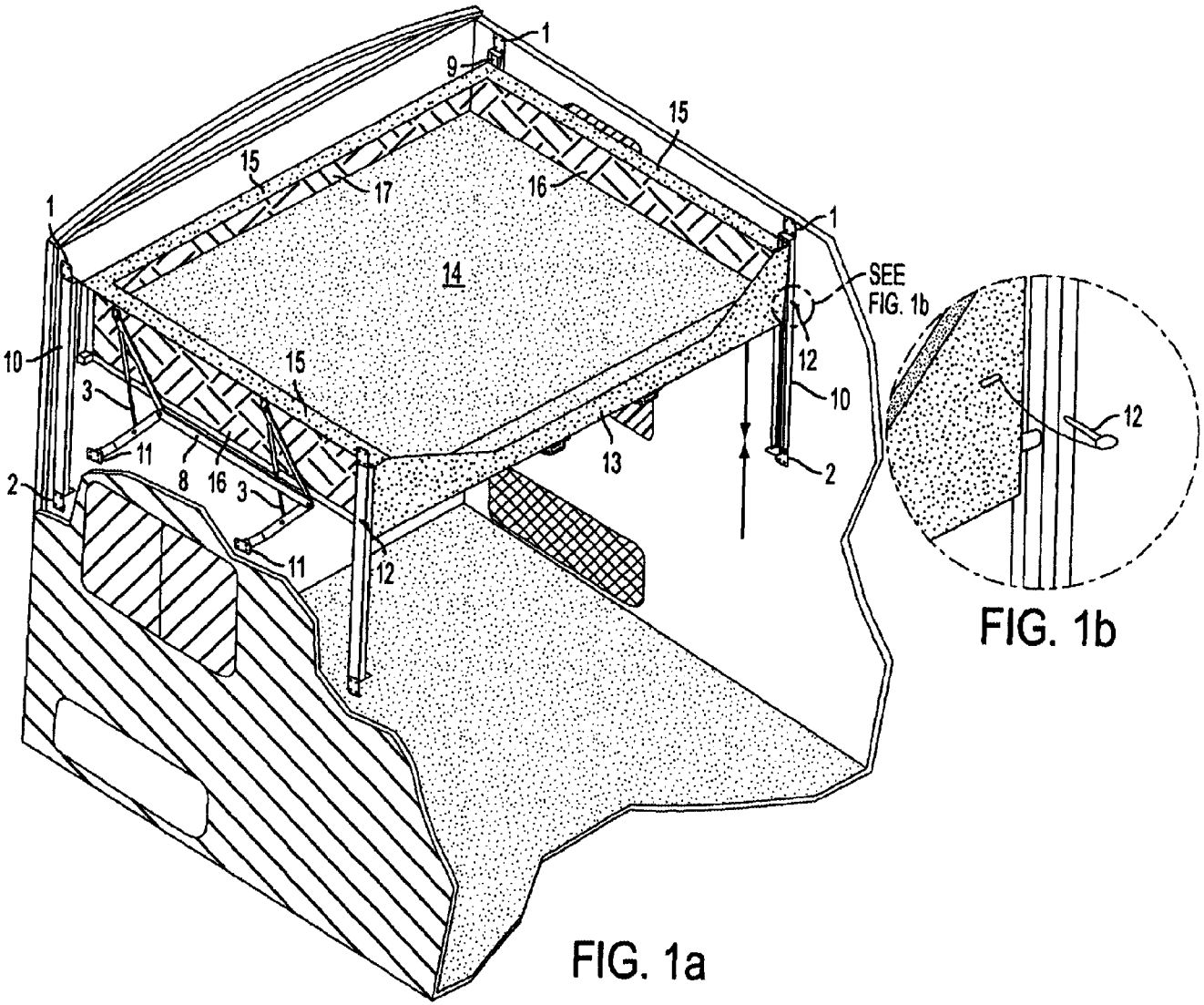
FIGS. 1*a* and 1*b* are a schematic diagram and enlarged detail depiction of an embodiment of the lift bed of the present invention including a mattress.

It is understood that the present invention is not limited to the particular methodologies, protocols, and apparatus, etc., described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include plural reference unless the context clearly dictates otherwise. Thus, for example, a reference to "a glide block" is a reference to one or more glide blocks and includes equivalents thereof known to those skilled in the art and so forth.

Unless defined otherwise, all technical and scientific terms used herein have the same meanings as commonly understood by one of ordinary skill in the art to which this invention belongs. Preferred methods, devices, and materials are described, although any methods and materials similar or equivalent to those described herein can be used in the practice or testing of the present invention. All references cited herein are incorporated by reference herein in their entirety.

The present invention relates to a vertical lift bed or similar platform allowing raising and lowering of the lift bed from storage to use positions. The present invention comprises a bed frame, safety devices, and movement means. The lift bed may be designed to be moved safely by a single push or pull movement through use of a movement means, such as for example, equalized scissor-type control arms. In one embodiment, a single person may operate the lift bed while standing away from the lift bed assembly without being positioned beneath the weight mass, and may achieve a vertical lift or lowering of the assembly. In another embodiment, the use of equalized scissor-type control arms in combination with struts may provide a mechanical advantage allowing the bed to be raised or lowered by one person. In one embodiment of the present invention, the struts may be gas or pneumatic pistons. In other embodiments, the struts may be springs. In yet another embodiment, the struts may be a combination of gas, air, springs, or other pneumatic devices.

The use of equalized scissor-type control arms in combination with gas spring piston struts may balance or center the weight of the lift bed to allow a fore or aft vertical lift, without necessitating multiple operations or steps by a single operator. The use of scissor-type control arms in combination with vertical tracks and glide blocks that glide within the tracks may maintain the vertical motion of the bed and may keep the bed in a substantially horizontal position.

The lift bed may glide up and down a vertical track that extends from the upper portion of a side wall of the trailer to the use position of the lift bed through use of glide blocks that fit within the glide tracks. In one embodiment, the glide tracks may incorporate stops, brackets, or other limiting devices designed to limit vertical movement and support the. weight of the bed assembly in the upward and downward positions. The lift bed may be utilized as a sleeping area in the full down position and may also be used for storage in the up or down position. In another embodiment, the lift bed may be positioned such that it allows the space below the bed to be utilized for any other purpose providing reasonable headroom for an average person.

The lift bed may also incorporate various safety restraints for child protection and for stabilizing purposes in the sleeping and use positions. These restraints may include straps or pin and lanyard devices, for example. In a specific embodiment, the scissor assembly equalizing system design and safety restraints hold the assembly in the up position for maximum vertical storage in the cargo/living areas.

A specific embodiment of the present invention includes a bed frame, means for moving the bed frame and safety devices.

The lift bed may also include a bed frame, which has a base, end panels, side panels, supports, and a front panel that may include an open space for receiving a mattress.

FIGS. 1*a* and 1*b* depicts a completed embodiment including a mattress 14 and the safety devices of the present invention. Safety restraints 12 are utilized to secure the complete assembly in the transit position from possible traveling hazards while the vehicle is in motion. Safety restraints 12 may be pin and lanyard devices with holes drilled horizontally through vertical tracks 10 and through glide blocks 9 to mechanically secure glide blocks 9 to vertical tracks 10 preventing movement and may be attached to the support 13, but may also be any other mechanically equivalent safeguard, such as straps.

Figure 2:
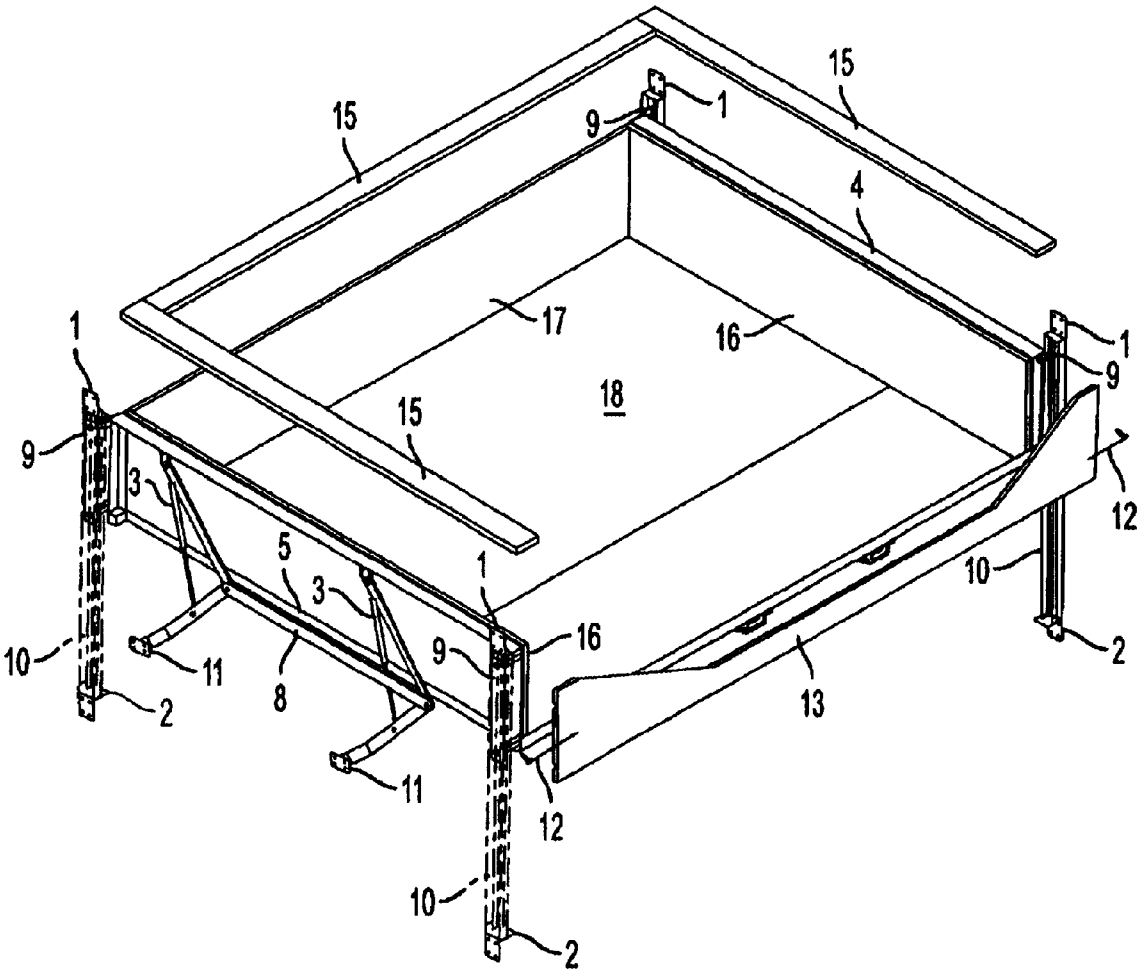
FIG. 2 is a schematic diagram of an embodiment of the framework of the lift bed of the present invention.

An embodiment of the lift bed frame is depicted in FIG. 2. Base platform 18 provides support for a conventional mattress and bedding and may also support the weight of one or more persons in a sleeping or resting area. Vertical end panels 16 and 17 interlock with base platform 18 and support 13 to form the bed frame. Support 13 may be the front of the bed frame and may allow access to and from the sleeping area. Support 13 may be open ended and may also be a gusset-type support. Top bolsters 15 may be fastened to the vertical end panels 16 and 17 to complete the enclosure. The top bolsters 15 may be utilized as a buffer from the hard surfaces of the top sections and may compliment the aesthetics of the finished product. End rails 6, as depicted for example in FIG. 3, span and connect side frame rails 4 and 5 together. Side frame rails 4 and 5 secure the control arms 8, glide blocks 9, and struts 3 position within the vertical tracks 10.

Figure 3:
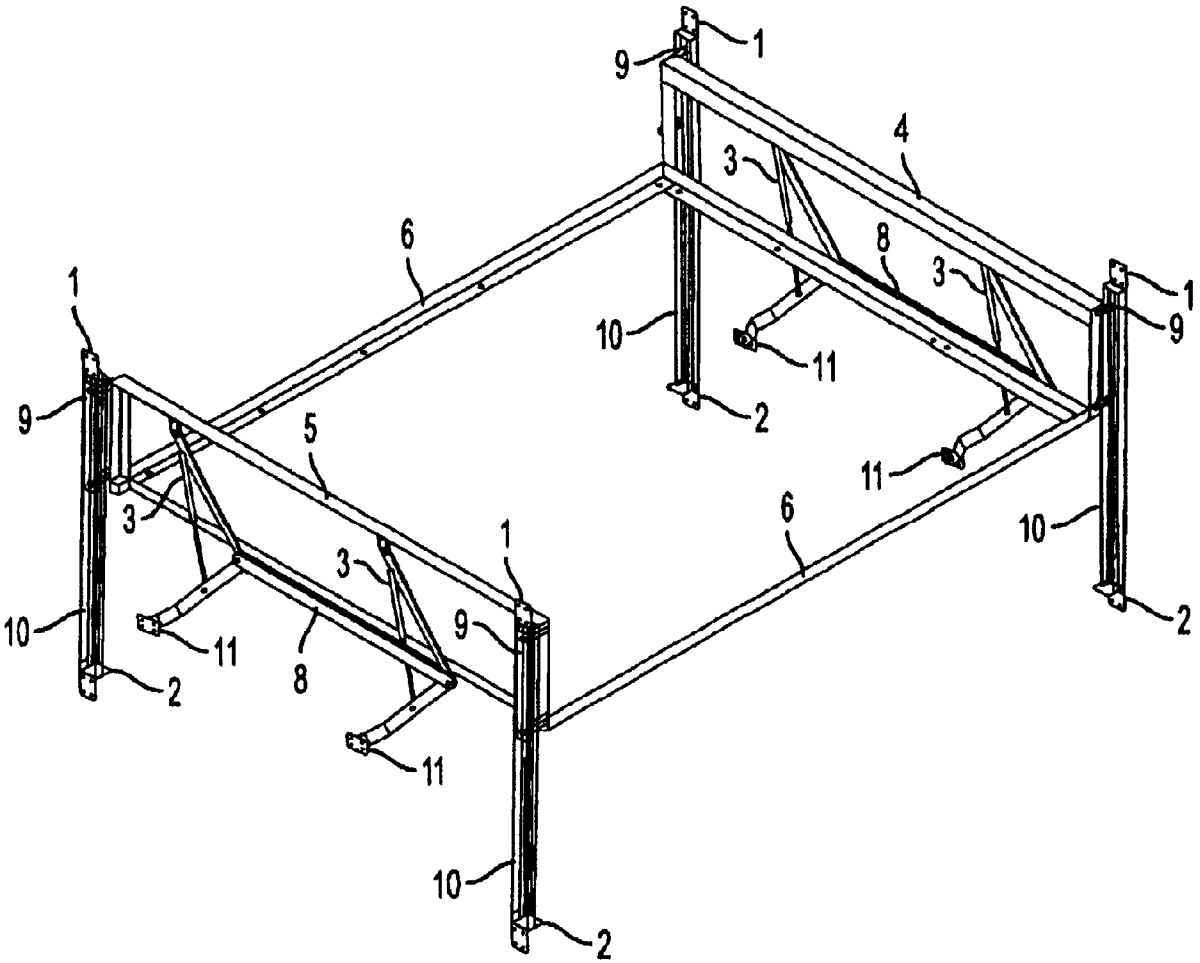
FIG. 3 is a schematic diagram of an embodiment of the framework of the lift bed of the present invention.

FIG. 3 depicts an embodiment of movement means of the present invention. Vertical tracks 10 may be rails or any other means adapted to interact with glide blocks 9 to provide a smooth gliding motion. The span and position of the vertical tracks 10 may vary and are dependent on the size of the finished product and desired mattress size. Glide blocks 9 may be positioned inside the vertical tracks 10 and are attached to the bed frame. Glide blocks 9 are adapted to glide up and down the tracks and assist the vertical motion of the bed frame and also allow the bed frame to move in a substantially horizontal position.

Upper track supports 1 and lower track supports 2 may be fastened to the structure of a confined living space, such as the walls of a recreation vehicle, to position and lock the vertical tracks 10 into position. The walls to which tracks 10 are attached may be side walls or front and back walls. Alternatively, the tracks 10 may be attached to only one wall, such as, for example, a rear wall. It is alternatively possible for fewer tracks 10 to be fixed to a single wall or on diagonals. The lower track supports 2 may be positioned and secured to the structure to limit downward travel and support the weight mass. The upper track supports 1 may limit and stop vertical upward motion of the lift bed.

In a specific embodiment, control arms 8 may be scissor-type arms and may be capable of equalizing a load through damping characteristics. Struts 3 may be gas spring pistons for example, or alternatively, a gas or spring piston or any mechanical equivalent, such as a pneumatic piston. The lower mounting brackets 11 are positioned and secured to the vehicle structure or walls and lower ends of control arms 8. Lower mounting brackets 11 may hold a pivotal position of control arms 8.

In an embodiment of the present invention, the positioning and location of struts 3 and control arms 8 can be crucial to achieve the optimal load force necessary to lift or lower an assembled lift bed. Additionally, the length of struts 3 and control arms 8 affect this load force and are also dependent upon the size mattress that is desired. The positioning and pivotal points of the control arms 8, and the upper attachment of the control arms to the side frame rails 4 and 5, may be positioned to counterbalance and support the assembled weight mass.

Figure 4:
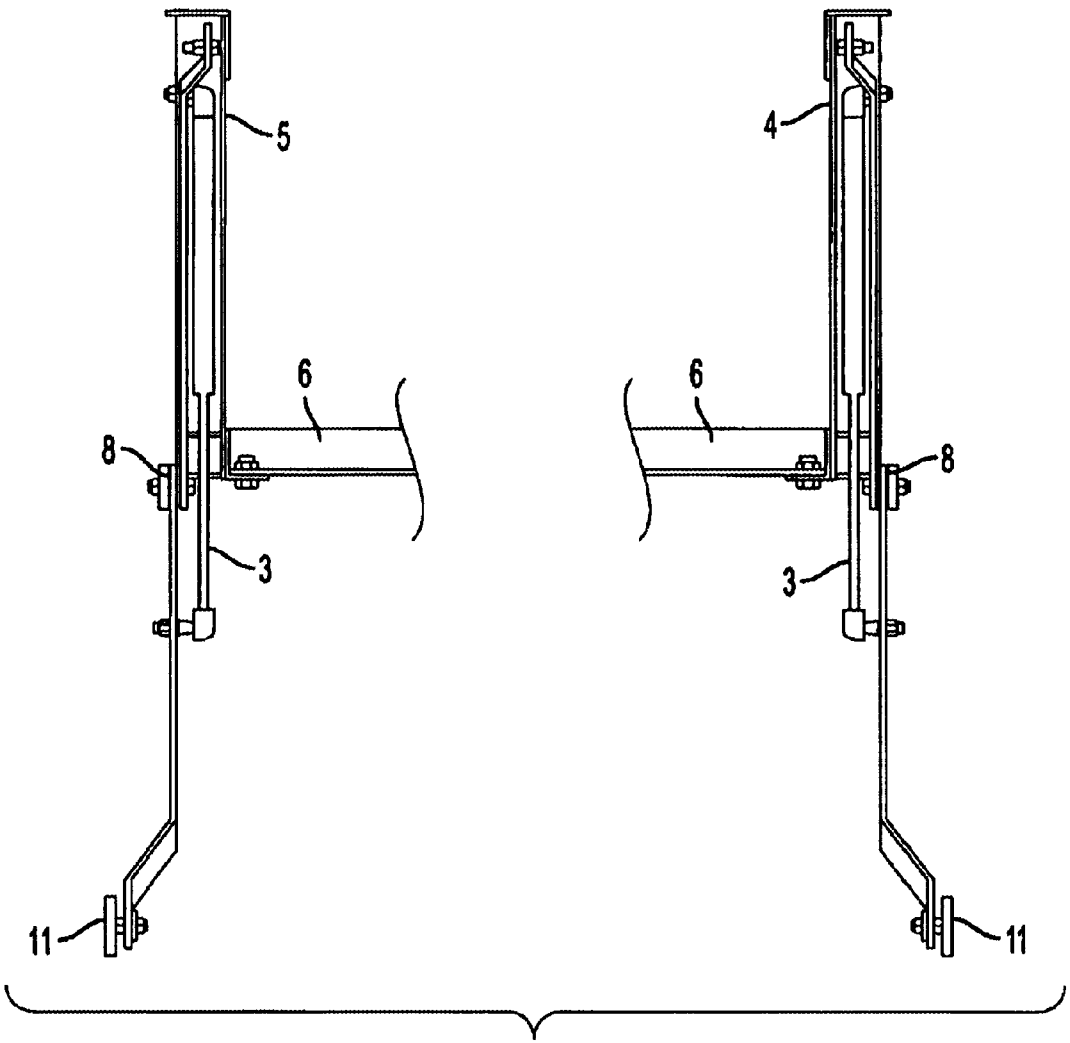
FIG. 4 is a schematic diagram of one embodiment of the strut and control arm assembly of the present invention.

FIG. 4 depicts an interface between control arms 8 and struts 3 and the lower mounting brackets 11 for the control arms 8.

Figure 5:
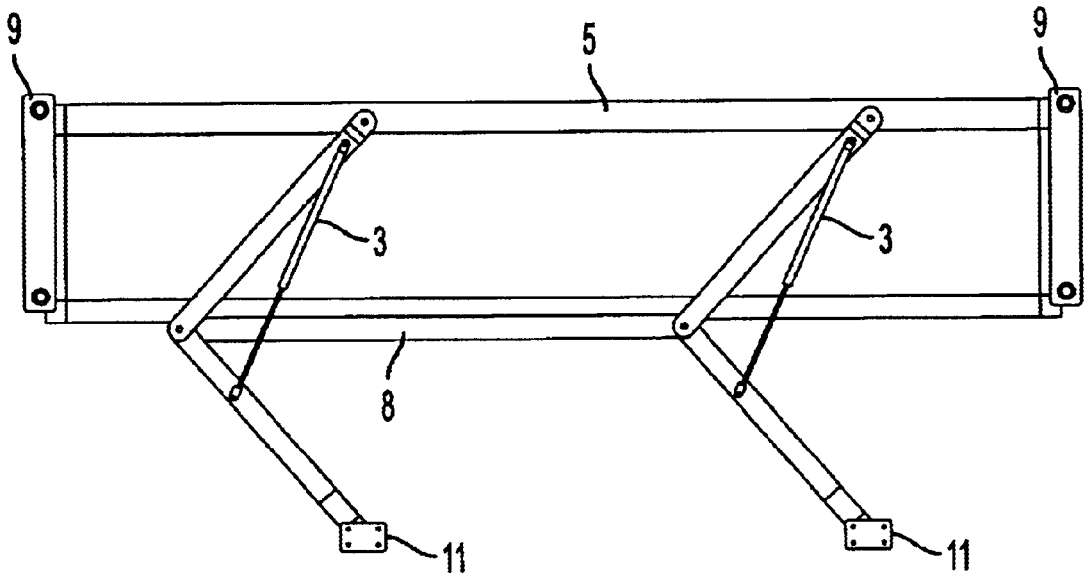
FIG. 5 is a side view of one embodiment of the strut and control arm assembly of the present invention.
Figure 6A:
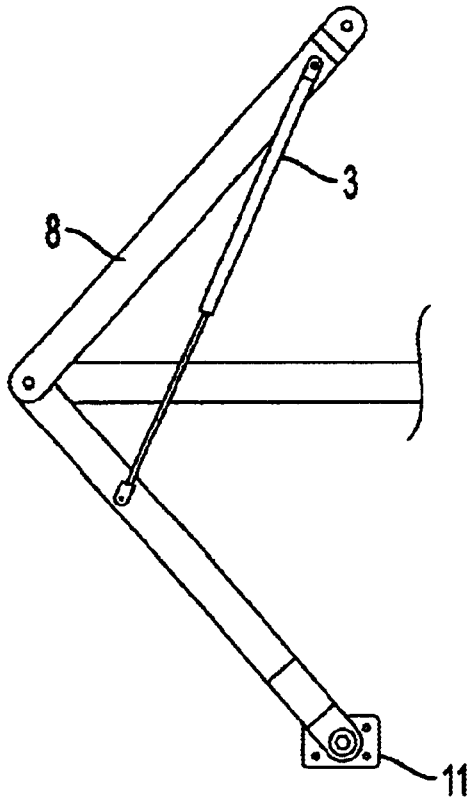
FIG. 6A is a schematic diagram of the movement means of the present invention when the lift bed is in its upward position.
Figure 6B:
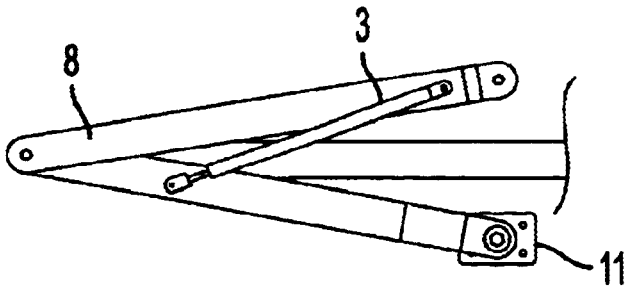
FIG. 6B is a schematic diagram of the movement means of the present invention when the lift bed is in its downward position.

FIG. 5 depicts a side view of control arm 8 and struts 3. As is shown, struts 3 are fastened to each end of each control arm 8. Control arms 8 are connected to each other and move in tandem. When the lift bed is in its most upward position, struts 3 and control arms 8 are fully extended as shown in FIG. 6A. Conversely, when the lift bed is in its most downward position, struts 3 and control arms 8 are contracted as shown in FIG. 6B.

Figure 7A:
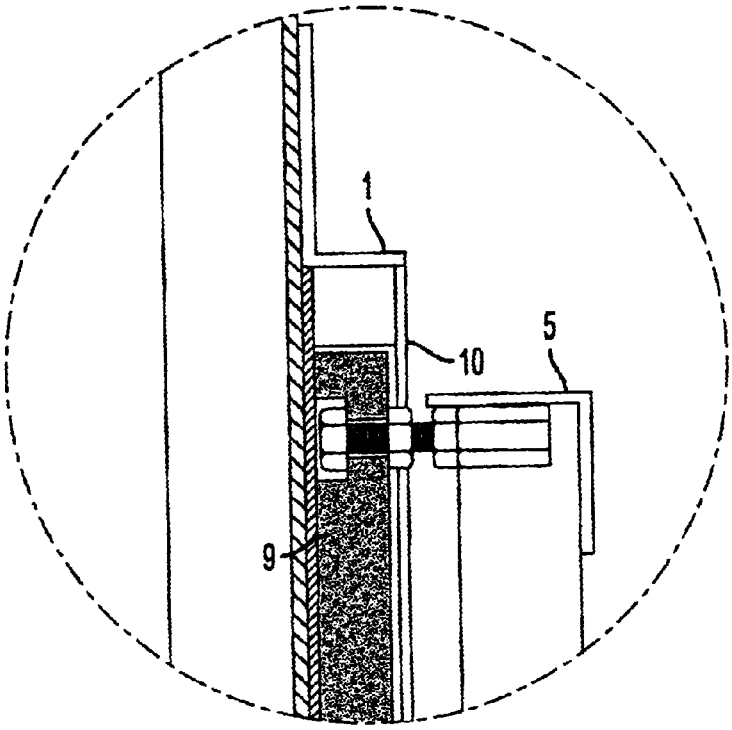
FIG. 7A is an enlarged detail depiction of one embodiment of an upper glide assembly
Figure 7B:
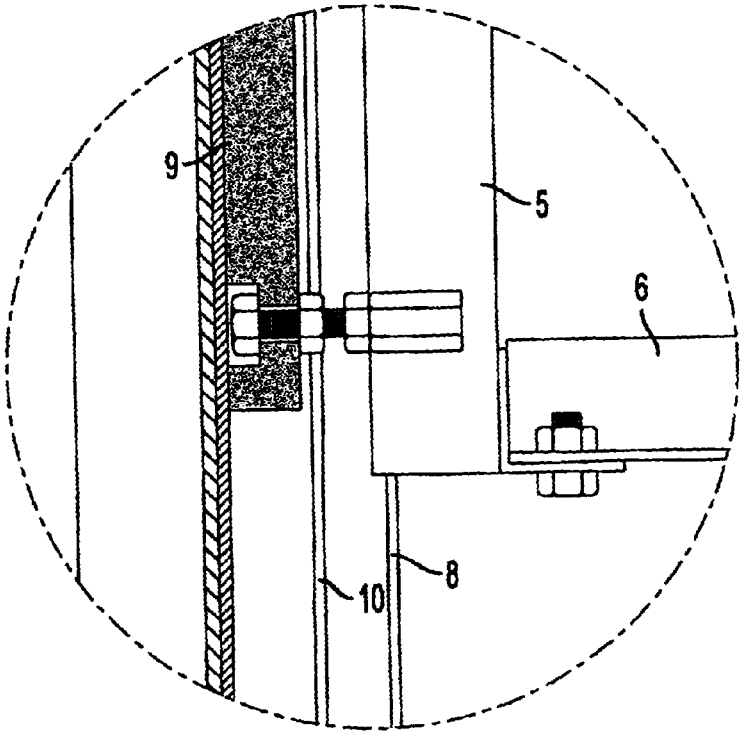
FIG. 7B is an enlarged detail depiction of one embodiment of a lower glide assembly.
Figure 8A:
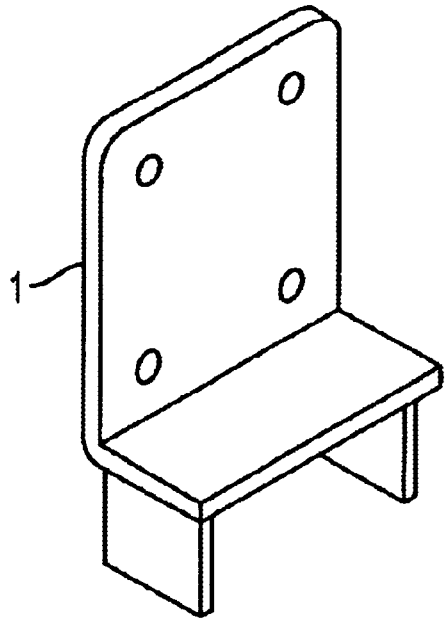
FIG. 8A is an enlarged detail depiction of one embodiment of an upper track support.
Figure 8B:
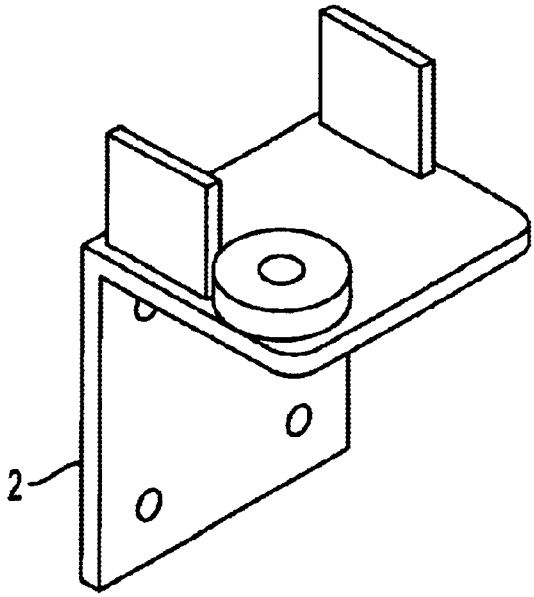
FIG. 8B is an enlarged detail depiction of one embodiment of a lower track support.

An embodiment of upper and lower glide assemblies are shown in FIGS. 7A and 7B, respectively. The upward motion of glide block 9 can be limited by upper track support 1, which may be, for example, a bracket or a stop. Glide block 9 fits inside vertical track 10 and is attached to side rail 5 and/or may also be attached to side rail 6. Similarly, the downward motion of glide block 9 is limited by lower track support 2, which may be, for example, a bracket or a stop. Upper track support 1 and lower track support 2 are depicted in FIGS. 8A and 8B, respectively. Alternatively, instead of glide blocks, other devices such as pins, rollers, or similar devices which slide, roll, glide or move easily within tracks or similar guides may be used.

Various modifications and variations of the described methods and systems of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are obvious to those skilled in this or related fields are intended to be within the scope of the following claims.

What is claimed is:

1. A vertical lift bed for use in a confined living space comprising:

a bed frame connected to a control arm assembly;

a vertical track attached to at least one wall of said confined living space;

a glide block adapted to fit and glide within said vertical track;

a control arm assembly comprising at least two arms each with two ends, one end of each arm connected to a wall of said confined living space, the other end of said arm connected to said bed frame, wherein said arms allow a controlled substantially vertical lift or lowering of said lift bed; and a strut fastened to two positions on said arm.

2. The lift bed of claim 1, wherein said lift bed may be raised or lowered by one person.

3. The lift bed of claim 1, wherein said vertical tracks further comprise limiting devices to limit the motion of said lift bed.

4. The lift bed of claim 3, wherein said limiting devices further comprise devices selected from the group consisting of brackets and stops.

5. The lift bed of claim 3, wherein said limiting devices support said lift bed in an upward position.

6. The lift bed of claim 1, wherein said control arm assembly maintains said lift bed in a substantially horizontal position.

7. The lift bed of claim 1, wherein said lift bed further comprises a safety restraint to maintain said lift bed in an upward position.

8. The lift bed of claim 1, wherein said lift bed is adapted to be lowered or lifted in a single motion.

9. The lift bed of claim 1 wherein said struts are self-contained gas struts.

10. The lift bed of claim 1, wherein said struts are selected from the group consisting of gas struts, spring struts, gas and spring struts, and pneumatic struts.

11. A vertical lift bed for use in a confined living space comprising:

a bed frame connected to a control arm assembly;

a control arm assembly comprising at least two arms each with two ends, one end of each arm connected to a wall of said confined living space, the other end of said arm connected to said bed frame, wherein said arms allow a controlled substantially vertical lift or lowering of said lift bed; and a strut fastened at two positions on said arm.

12. The lift bed of claim 11, wherein said lift bed may be raised or lowered by one person.

13. The lift bed of claim 11, further comprising vertical tracks attached to at least one wall of said confined living space, wherein said vertical tracks comprise limiting devices to limit the motion of said lift bed.

14. The lift bed of claim 13, wherein said limiting devices support said lift bed in an upward position.

15. The lift bed of claim 11, wherein said control arm assembly maintains said lift bed in a substantially horizontal position.

16. The lift bed of claim 11, wherein said lift bed further comprises a safety restraint to maintain said lift bed in an upward position.

17. The lift bed of claim 11, wherein said lift bed is adapted to be lowered or lifted in a single motion.

18. The lift bed of claim 11 wherein said struts are self-contained gas struts.

19. The lift bed of claim 11, wherein said struts are selected from the group consisting of gas struts, spring struts, gas and spring struts, and pneumatic struts.

20. A vertical lift bed for use in a confined living space comprising:

a bed frame connected to a movement means;

track means attached to the walls of said confined living space; and glide means adapted to fit and glide within said track means;

wherein said movement means comprises at least two arms each with two ends, one end of each arm connected to a wall of said confined living space, the other end of said arm connected to said bed frame, wherein said arms allow a controlled substantially vertical lift or lowering of said lift bed and a strut fastened to two positions on said arm.

21. A vertical lift bed for use in a confined living space comprising:

a bed frame connected to a movement means track means attached to the walls of said confined living space;

glide means adapted to fit and glide within said track means; and a strut fastened on said movement means;

wherein said strut is selected from the group consisting of gas struts, spring struts, gas, and spring struts, and pneumatic struts.

22. The lift bed of claim 21, wherein said strut comprises a self-contained gas strut.

* * * * *